US009773625B2

(12) United States Patent
Gautier et al.

(10) Patent No.: US 9,773,625 B2
(45) Date of Patent: Sep. 26, 2017

(54) DEVICE FOR PROTECTING AN ELECTRICAL CIRCUIT FED BY AN ALTERNATING CURRENT WHICH CAN BE INTEGRATED INTO A CONTACTOR

(71) Applicant: ECE, Paris (FR)

(72) Inventors: Frederic Gautier, Gagny (FR); David Balaine, Verneuil en Halatte (FR)

(73) Assignee: ECE, Paris (FR)

( * ) Notice: Subject to any disclaimer, the term of this patent is extended or adjusted under 35 U.S.C. 154(b) by 789 days.

(21) Appl. No.: 13/671,206

(22) Filed: Nov. 7, 2012

(65) Prior Publication Data

US 2013/0127583 A1 May 23, 2013

(30) Foreign Application Priority Data

Nov. 16, 2011 (FR) ..... 11 60451

(51) Int. Cl.

| | |
|---|---|
| ***H01H 9/10*** | (2006.01) |
| ***H01H 85/54*** | (2006.01) |
| ***H01H 1/20*** | (2006.01) |
| ***H01H 85/00*** | (2006.01) |
| ***H01H 85/60*** | (2006.01) |
| ***H01H 50/54*** | (2006.01) |
| *H01H 1/22* | (2006.01) |

(52) U.S. Cl.

CPC ..... *H01H 9/10* (2013.01); *H01H 1/2008* (2013.01); *H01H 9/102* (2013.01); *H01H 50/546* (2013.01); *H01H 85/0086* (2013.01); *H01H 85/54* (2013.01); *H01H 85/547* (2013.01); *H01H 85/60* (2013.01); *H01H 2001/223* (2013.01)

(58) Field of Classification Search

CPC ..... H01H 9/10; H01H 85/54; H01H 1/2008; H01H 85/547; H01H 85/60; H01H 85/0086; H01H 2001/223

USPC ..... 337/6, 142, 186, 220, 249

See application file for complete search history.

(56) References Cited

U.S. PATENT DOCUMENTS

| | | | | |
|---|---|---|---|---|
| 2,186,813 A * | 1/1940 | Adam | H01H 9/102 | 337/194 |
| 2,249,014 A * | 7/1941 | Lingal | H01H 9/102 | 337/176 |
| 2,423,227 A * | 7/1947 | Cole | H01H 9/102 | 337/196 |
| 2,834,855 A * | 5/1958 | Carpenter | H01H 9/102 | 218/43 |

(Continued)

FOREIGN PATENT DOCUMENTS

| | | |
|---|---|---|
| EP | 0852388 | 7/1998 |
| FR | 1360265 | 5/1964 |

OTHER PUBLICATIONS

Search Report for French Patent Application No. FR 1160451 issued Jun. 11, 2012.

*Primary Examiner* — Anatoly Vortman

(74) *Attorney, Agent, or Firm* — Meyertons, Hood, Kivlin, Kowert & Goetzel, P.C.

(57) ABSTRACT

Device for protecting an electrical circuit fed by an alternating current, comprising a housing and a fuse element disposed in the housing. The housing comprises a first portion and a second portion which are mobile in relation to one another, and elastic means suitable for causing the first portion to bear against the second portion and causing the housing to be set in a closed state.

5 Claims, 4 Drawing Sheets

(56) References Cited

U.S. PATENT DOCUMENTS

| | | | | | |
|---|---|---|---|---|---|
| 3,599,135 | A * | 8/1971 | Gryctko | H01H 9/10 | 337/236 |
| 5,179,436 | A * | 1/1993 | Asdollahi | H01H 85/43 | 337/203 |
| 5,287,079 | A * | 2/1994 | Bernardi | H01H 85/0417 | 337/203 |
| 5,969,587 | A * | 10/1999 | Combas | H01H 85/545 | 335/132 |
| 6,005,470 | A * | 12/1999 | Smith | H01H 85/42 | 337/273 |
| 6,542,063 | B2 * | 4/2003 | Kawashima | H01H 85/0417 | 337/186 |
| 6,762,670 | B1 * | 7/2004 | Yen | H01H 85/0082 | 337/203 |
| 2007/0109704 | A1 * | 5/2007 | Apfelbacher | H01H 9/102 | 361/93.1 |
| 2007/0293082 | A1 | 12/2007 | Sumitani et al. | | |
| 2011/0193675 | A1 * | 8/2011 | Darr | H01H 9/104 | 337/187 |

* cited by examiner

DEVICE FOR PROTECTING AN ELECTRICAL CIRCUIT FED BY AN ALTERNATING CURRENT WHICH CAN BE INTEGRATED INTO A CONTACTOR

BACKGROUND OF THE INVENTION

1. Field of the Invention

The invention relates to the protection of an electrical circuit fed by an alternating current, and more particularly the integration of a fuse into a mobile contactor coupled to an electrical circuit fed by an alternating current.

2. Description of the Relevant Art

A fused circuit breaker is used primarily as a safety device in electrical or electronic circuits. The role of a safety device of this type is to open an electrical circuit with which it is associated when the current flowing through the latter reaches a dangerous intensity, thereby returning this current to a zero intensity. A protection of this type generally guarantees the integrity of the electrical circuit, and more particularly the integrity of the power supply circuit and the restoration into service of the circuit once the fault has been cleared. A circuit breaker thus allows the potentially catastrophic consequences which a lasting overcurrent or short circuit would cause, such as, for example, degradation of the insulators, destruction of the electronic equipment, melting of material or even the start of a fire.

A fused circuit breaker, more simply referred to as a "fuse", operates through the melting of a fuse element. The melting of the fuse element is caused by the temperature rise due to the overcurrent passing over the fuse. The fuse generally comprises a conductive part, for example a conductive filament or a strip made of a fusible metal or alloy, mounted in an insulating body and connected to two connection pieces. When the current passing over the conductive part exceeds the rating, i.e. the intensity threshold above which the conductive part begins to melt, the conductive part of the fuse melts and opens the circuit.

The insulating body of the fuse may contain air or a material intended to absorb the thermal energy released during the melting of the conductive part. Silica powder or an insulating liquid may thus be used to fill the internal volume of the body. The insulating body is generally implemented in the form of a ceramic or glass laminate cylinder, the ends of which are each provided with a crimped metal bell which is coupled, on the one hand, to the conductive part disposed inside the insulating body and, on the other hand, to a connection tab.

The main disadvantage of a safety device of this type lies in the occupied volume. In the case of a mobile contactor mounted in a reduced space, a safety device of this type cannot be mounted on the contactor without the volume in which the contactor is mounted being changed.

SUMMARY OF THE INVENTION

The invention proposes to overcome this disadvantage by proposing a device and a method for protecting an electrical circuit which can be implemented in an electrical device such as a contactor, realized in such a way that the additional occupancy volume of the protected contactor is limited. Another object of the invention is to propose a protection device which can be integrated into an electrical device and is simple to implement.

According to one aspect, a device is proposed in one embodiment for protecting an electrical circuit fed by an alternating current, comprising a housing and a fuse element disposed in the housing.

According to one general characteristic of the invention, the housing comprises a first portion and a second portion which are mobile in relation to one another, and elastic means suitable for causing the first portion to bear against the second portion and causing the housing to be set in a closed state.

The first portion and the second portion are separated from one another in the event of the appearance of an electric arc generated following the melting of the fuse element, notably caused by a short circuit. In fact, the melting of the fuse element and its consecutive vaporization cause an increase in the temperature and consequently the pressure inside the housing, forcing the first portion and the second portion to move apart from one another when the internal pressure becomes substantial.

Advantageously, the elastic means are implemented in such a way as to allow the separation of the first portion and the second portion of the housing when the pressure in the housing is greater than a threshold.

The first portion and the second portion of the housing thus become separated from one another when the pressure in the housing is greater than a pressure threshold corresponding to the recoil force of the elastic means.

The protection device preferably comprises at least two connection terminals coupled on either side of the fuse element and fixed onto the second portion, the first and second portions being implemented in such a way that they become separated from one another according to the direction defined by the two connection terminals.

The first portion may comprise a groove suitable for forming, with the second portion, a closed tunnel around the two connection terminals and the fuse.

The opening of the housing according to the direction defined by the two connection terminals facilitates the expansion of the electric arc outside the housing, and consequently facilitates the breaking of the electric arc when the housing closes. In fact, by opening the housing according to the direction defined by the two connection terminals, the opening via which the electric arc can extend outside the housing is greater than if, for example, the housing opened according to a direction orthogonal to the direction defined by the two connection terminals.

The first portion and the second portion of the housing preferably comprise a material with a non-carbonisable surface on their inner surface.

The generation of an electric arc in the housing causes a substantial temperature increase. The use of a non-carbonisable material to implement at least the inner surface of the housing prevents the electric arc from burning parts of the inner surface of the housing, then leaving traces of carbon on this surface. These traces of carbon would encourage disruptive discharges and consequently the reformation of the electric arc.

Advantageously, the fuse may comprise at least one brazed joint implemented between the two connection terminals.

A brazed joint is a point of the fuse element which is thinner than over the remainder of the fuse. The implementation of one or more brazed joints in the fuse allows the place where the fuse will break and where the arc will be generated to be controlled, and also the intensity of the current for which the fuse element melts and breaks to be controlled.

According to a different aspect, an electrical contactor is proposed comprising a switching element suitable for opening or closing an electrical circuit fed by an alternating current, and control means suitable for controlling the switching element to open or close the electrical circuit.

According to one general characteristic, the switching element comprises a protection device. A switching element of this type can be implemented in such a way as to comprise a housing separable into two portions along a direction defined by the two connection terminals to which the fuse element is coupled.

The contactor preferably comprises electrical coupling terminals connected to the electrical circuit, the switching element comprises at least two connection studs connected respectively to the connection terminals of the protection device, and the control means comprise movement means coupled to the switching element and allowing the switching element to be moved between an open position of the electrical circuit where the connection studs are decoupled from the electrical coupling terminals and a closed position of the electrical circuit where the connection studs are coupled to the electrical coupling terminals.

The movement means of the mobile contactor may comprise an electromagnet coupled to a movement bar to which the switching element is mechanically coupled. The bar, activated by the electromagnet, moves the mobile switching element towards and outside the electrical coupling terminals.

The contactor preferably comprises elastic contact means coupled to the movement means in such a way as to bring the switching element to the closed position of the electrical circuit, the elastic contact means comprising said elastic means of the protection device.

The elastic contact means and said elastic means of the protection device can be combined.

The contactor can thus comprise a spring mechanically coupled between the bar of the electromagnet and the switching element. The first objective of this spring is to maintain a pressure force on the switching element in order to keep it in contact with the electrical coupling terminals. The second objective of this spring is also to serve as elastic means of the protection device allowing the first portion and the second portion of the housing to be kept together in such a way as to keep the tunnel of the housing closed until the pressure inside the housing exceeds the threshold.

The contactor may advantageously be a contactor with a power greater than 30A or an RCCB (Remote Control Circuit Breaker).

According to a different aspect, a method is proposed in one embodiment for protecting an electrical circuit fed by an alternating current, comprising the generation of an electric arc following the melting of a fuse element in a housing caused by a current increase linked to a short circuit.

According to one general characteristic, the protection method comprises:

a) an opening of the housing,
b) an expansion of the electric arc outside the housing,
c) a closing of the housing,
d) a breaking of the electric arc when the housing closes,
e) a repetition of steps a) to d) if the electric arc is reformed.

The pressure, temperature and current conditions and the dimensions of the portions of the fuse element, inter alia, permitting, it is possible that an electric arc will again form following a closure of the housing breaking the preceding electric arc. In fact, if the short-circuit current is high and the distance separating the two portions of the fuse element, i.e. the two portions not yet having been vaporised, is relatively short, it is possible that an electric arc will form.

Advantageously, the housing opens when the pressure in said housing is greater than a threshold and closes when said pressure is below the threshold, the pressure in said housing reducing when the absolute value of the alternating current reduces.

The pressure in the housing also reduces with the opening of the housing over a greater volume. This pressure reduction also contributes to the overall reduction of the pressure in the housing allowing the closure of the housing.

BRIEF DESCRIPTION OF THE DRAWINGS

Other advantages and characteristics of the invention can be gleaned from the detailed description of different embodiments of the invention which are in no way limiting, and the attached drawings, in which.

Figure 1:
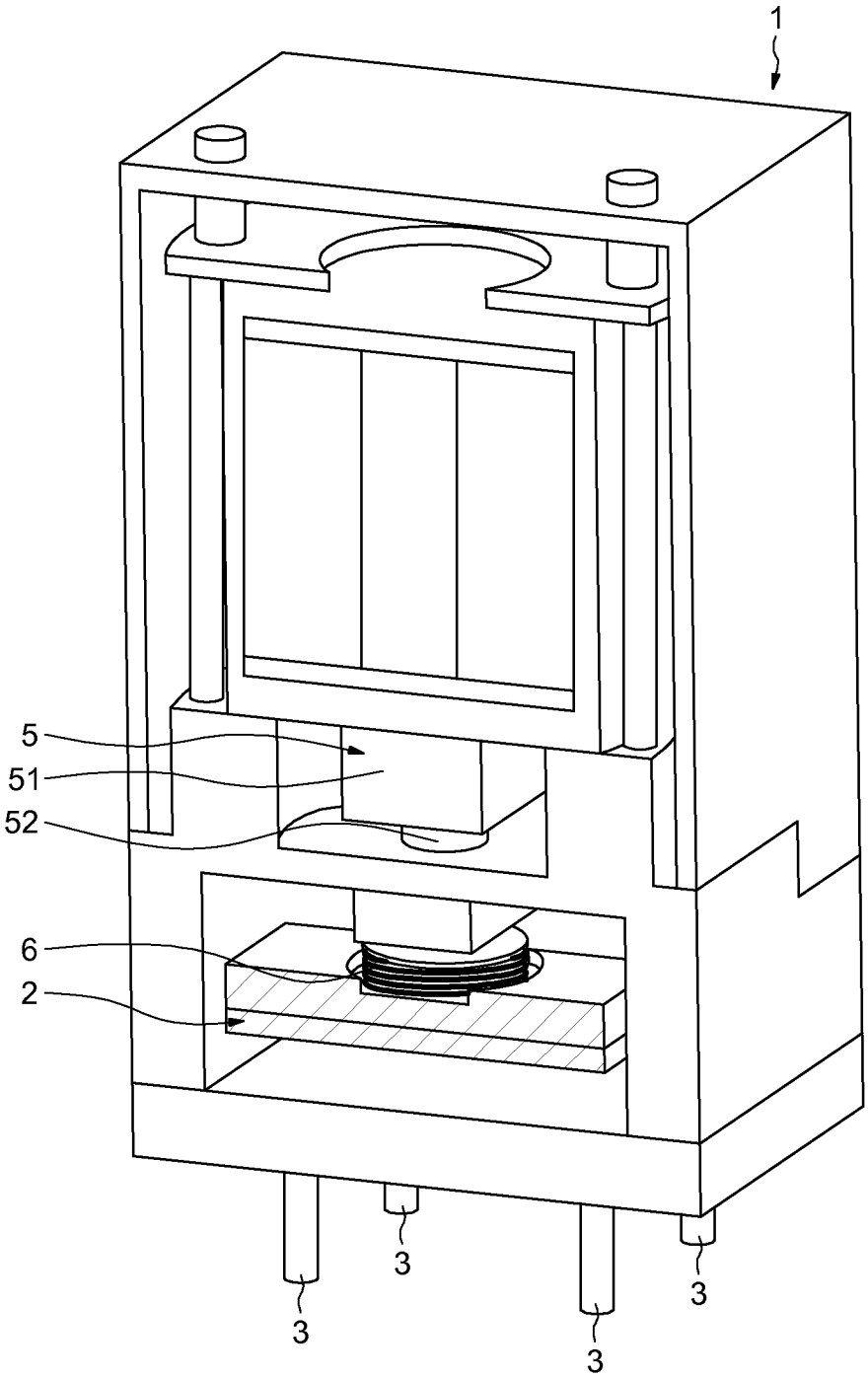
FIG. 1 shows a cross-section view of a mobile contactor comprising a switching element according to one embodiment of the invention.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

FIG. 1 shows a cross-section view of a mobile contactor 1 comprising a switching element 2 according to one embodiment of the invention.

The mobile contactor 1 is intended to be mounted on a power circuit of an aircraft to allow the opening or closure of the power circuit via the movement of the switching element 2. The contactor 1 comprises poles 3, or electrical coupling terminals, which are electrical contacts which allow the current in the power circuit to be established and interrupted.

The contactor 1 also comprises a control circuit and auxiliary contacts. These auxiliary contacts are intended to provide information on the state of the contactor (open or closed). The control circuit of the mobile contactor 1 also comprises an electromagnet 5. This electromagnet 5 comprises a copper coil and a magnetic circuit composed of a fixed part 51 and a mobile part 52. When the electromagnet 5 is supplied with power, a current flows through the coil which generates a magnetic field channeled by the magnetic circuit causing the mobile part 52 to move closer, thereby closing or opening the contact. This control circuit may advantageously be alternating, in which case the magnetic circuit will be able to be laminated.

The mobile part 52 of the electromagnet 5 is coupled to the contactor 1 via a spring 6. The spring 6 allows a pressure force to be applied to the contactor 1 in such a way that it is kept in contact with the poles 3 when the mobile part 52 is lowered.

Figure 2:
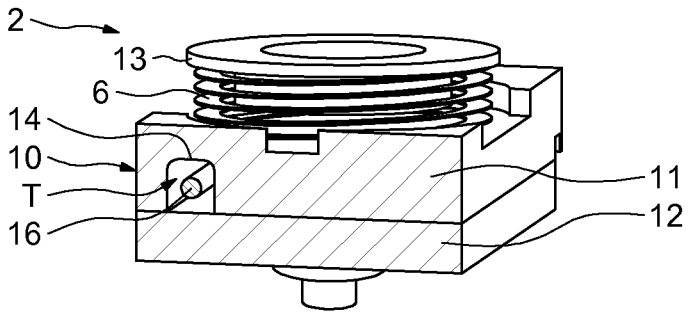
FIG. 2 shows a cross-section view according to a transverse plane of the mobile contactor in FIG. 1.
Figure 3:
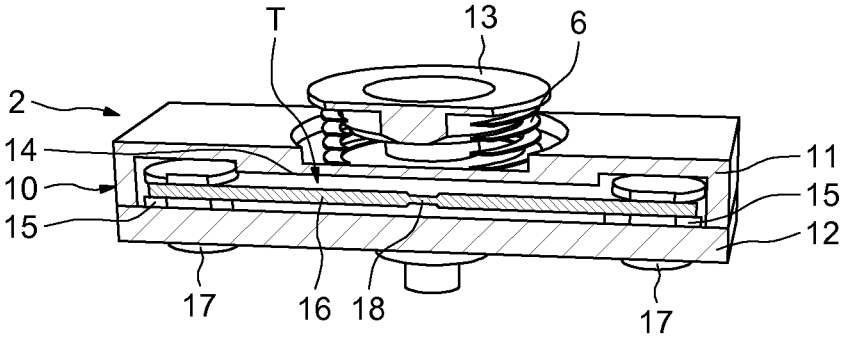
FIG. 3 shows a cross-section view according to a longitudinal plane of the mobile contactor in FIG. 1.

The mobile contactor 1 is presented in a detailed manner in FIGS. 2 and 3 which respectively show a cross-section view according to a transverse plane and a cross-section view according to a longitudinal plane of the mobile contactor 1.

The mobile contactor 1 comprises a housing 10 containing a first portion 11 and a second portion 12 mechanically coupled to a mechanical coupling element 13 intended to join the contactor 1 with the mobile part 52 of the electromagnet 5. The mechanical coupling element 13 orthogonally crosses the first portion 11 and the second portion 12. The spring 6 is mounted on the mechanical coupling element 13 in such a way as to be disposed above the first portion 11, supported on a surface opposite the surface facing the second portion 12.

The first portion 11 comprises a groove 14 implemented so that it does not cross the mechanical coupling element 13 and so that it does not emerge onto one of the ends of the first portion 11. Thus, when the first portion 11 is in contact with the second portion 12, the groove 14 forms a tunnel T closed at each end.

In the embodiment shown, the second portion 12 is implemented in such a way as to comprise a plate made from ceramic or a different material with a non-carbonizing surface. The first portion 11 can be implemented in the same material or in a different material with a non-carbonizing surface.

The second portion 12 comprises two connection terminals 15 between which a fuse 16 is connected. The connection terminals 15 and the fuse 16 are disposed on the second portion 12 in such a way that, when the first portion 11 is in contact with the second portion 12, i.e. when the housing 10 is closed, the tunnel T formed by the tunnel 14 and the second portion 12 comprises the fuse 16, and each connection terminal 15 is disposed at one end of the tunnel T. The groove 14 may be wider at its ends in such a way as to adapt to the size and shape of the connection terminals 15.

The connection terminals 15 are mounted on a surface of the second portion 12 facing the first portion 11, and are fixed in such a way as to be each respectively coupled to a connection stud 17 fixed on the opposite surface of the second portion 12.

The fuse 16 may be a filament or a conductive ribbon. In the embodiment shown in FIG. 3, the fuse 16 comprises a primer 18 corresponding to a section of the filament, the cross-section of which is smaller than over the remainder of the fuse 16. This primer 18 thus defines the breakpoint of the fuse 16 when an overcurrent, i.e. a current with an intensity greater than the nominal intensity, passes through said fuse. The diameter of the cross-section of the fuse 16 in the primer 18 also allows a precise definition of the value of the current as from which the fuse 16 must melt. If the primer 18 is not used, the fuse material must be a good thermal conductor so that the connections allow the ends of the fuse to cool and therefore cause melting in the central part of the fuse.

Figure 4:
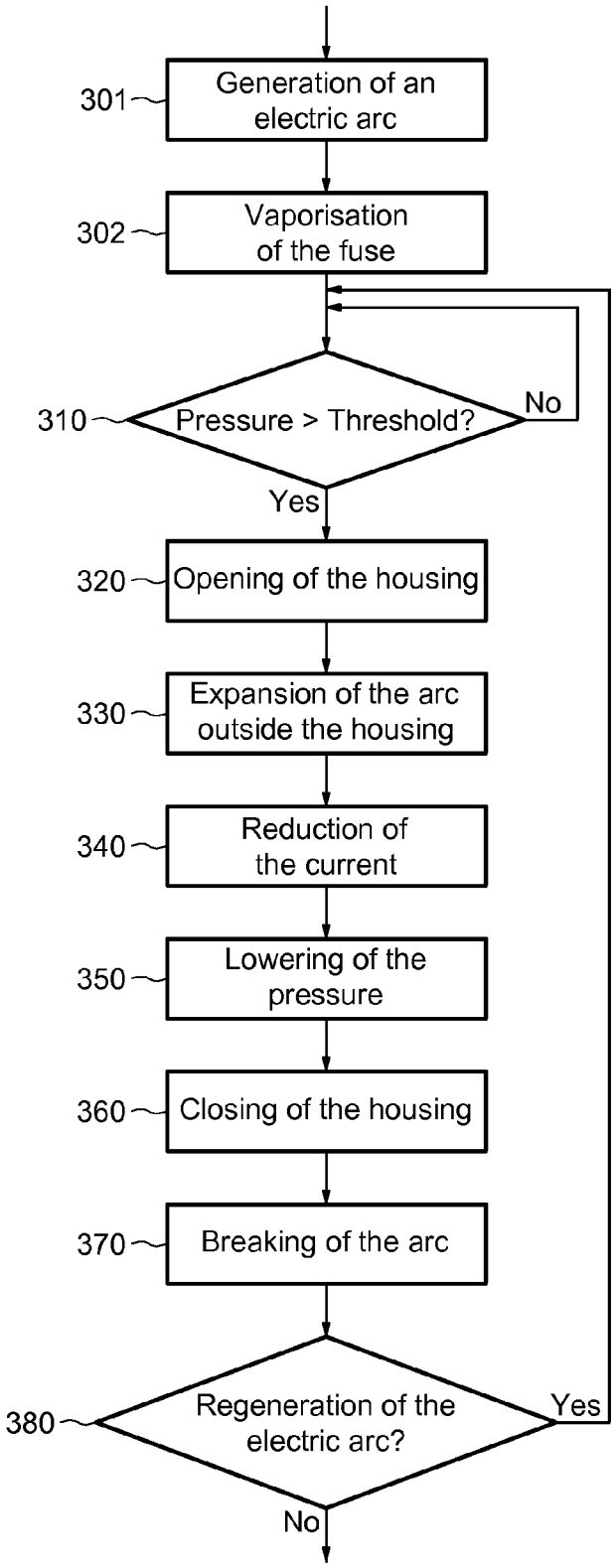
FIG. 4 shows a flow diagram of a protection method according to one embodiment.

With reference to FIG. 4, the coupler 1 which has just been described operates in the following manner.

When a current with an intensity greater than the nominal operating current passes over the fuse 16 for a prolonged period, the fuse 16 heats up, particularly in the primer 18 or in the middle of the fuse, increasing the resistivity of the fuse 16 as a function of temperature until it breaks at the brazed joint 18. The fuse 16 having heated up, the temperature in the tunnel T of the housing 10 rises. When the fuse breaks, the intensity of the current and the ambient temperature in the tunnel T are such that an electric arc is generated between the two portions of the broken fuse (step 301).

The electric arc thus generated between the two remaining portions of the fuse 16 electrically couples the two portions of the fuse 16, again increasing the temperature of the fuse 16 and the ambient temperature in the tunnel T. The increase in temperature of the fuse 16 continues until the fuse 16 vaporizes (step 302). The vaporization of the fuse 16 causes an increase in the temperature and consequently an increase in the pressure inside the tunnel T of the housing 10.

When the pressure inside the housing 10, and notably in the tunnel T, is greater than a pressure threshold (step 310), the first portion 11 and the second portion 12 become separated, causing the opening of the tunnel T (step 320). The pressure threshold corresponds to the pressure force exerted by the spring 6 on the first portion 11.

Once the tunnel T of the housing 10 is open, the electric arc extends outside the tunnel T (step 330).

The current being an alternating current, when the absolute value of the current reduces to approach a zero value, the intensity of the current in the electric arc reduces (step 340). The reduction in the intensity of the electric arc results in a fall in temperature and consequently a fall in pressure. Furthermore, the opening of the housing 10 has also resulted in an additional fall in pressure in the tunnel T of the housing 10.

The effect of these two falls in pressure (step 350) is to reduce the pressure in the housing 10, and notably in the tunnel T, to a value below the pressure threshold, then causing the closing of the housing 10 (step 360).

The closing of the housing 10, and therefore the tunnel T, is effected when the electric arc is outside the space defined by the tunnel T. The closing of the housing 10 therefore causes the breaking of the electric arc (step 370).

If the vaporization of the fuse 16 is not complete, so that portions of the fuse 16 remain close when they are still fed by a high-intensity overcurrent, it is possible that the electric arc will be regenerated (step 380). The steps 310 to 370 are then reiterated until the electric arc can no longer be regenerated, and the break takes effect.

Figure 5:
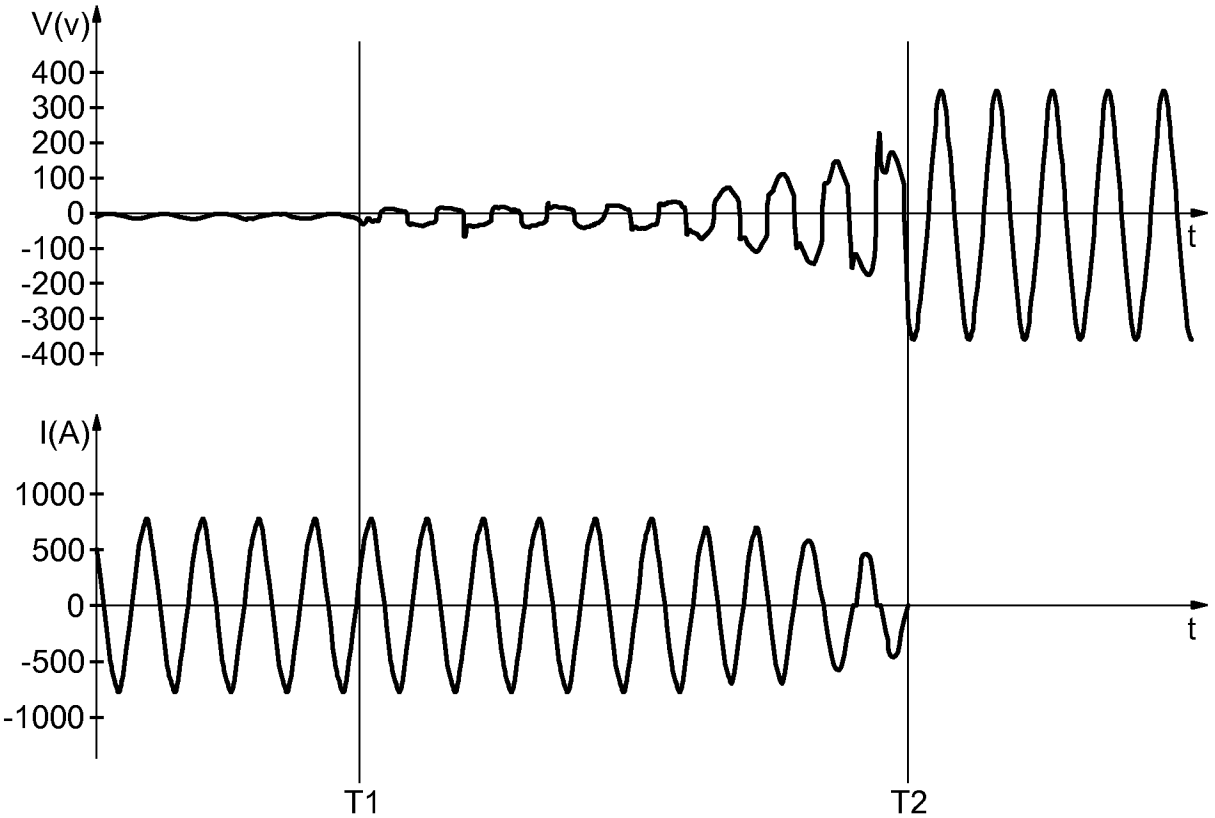
FIG. 5 shows an example of curves representing the voltage and current on the connection terminals during the appearance of an electric arc.

FIG. 5 shows a first curve representing the voltage V on the terminals of the fuse 16, i.e. measured between the two connection terminals 15, and a second curve representing the current I in amperes passing through the fuse 16. The two curves are shown as a function of time under conditions showing an example of generation of an electric arc.

In this example, before time t1, the current normally oscillates between −780A and 780A, and the voltage oscillates very slightly around a zero voltage. At time t1, the fuse 16 melts and an electric arc is generated. It is then observed that the arc voltage increases progressively while the current reduces until time t2, when the current is interrupted, the break of the electric arc then having been effected.

Between time t1 and time t2, each time that the current is nullified, the housing 10 re-closes, breaking the electric arc. Any regeneration of the electrical arc is represented on the voltage curve by a voltage peak. This voltage peak is clearly observable on each half-sine wave on the voltage curve V. With each half-sine wave of current, following a regeneration of the electric arc following the current nullification, the temperature and pressure again increase, causing a new opening of the housing 10 before the absolute value of the current reduces and is nullified. A fall in pressure, a closing of the housing 10, and consequently a breaking of the electric arc which had extended outside the tunnel T of the housing 10 are then observed.

This example shows a case of substantial overcurrent for which a plurality of cycles of opening and closing of the housing 10 are necessary to finally break the electric arc. Under different conditions, the electric arc can be finally broken as from the first closing of the housing 10.

The invention thus allows a device to be provided for protecting against a short circuit integrated in a contactor, the implementation of which is simple and the added weight compared with the original contactor is negligible.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An electrical contactor comprising:

a switching element opening or closing an electrical circuit fed by an alternating current;

control means controlling the switching element to open or close the electrical circuit, electrical coupling terminals connected to said electrical circuit; and wherein the switching element comprises a protection device, the protection device comprising a housing and a fuse element disposed in the housing, wherein the housing comprises:

a first portion and a second portion which are mobile in relation to one another;

elastic means that exerts a pressure force on the first portion causing the first portion to bear against the second portion and causing the housing to be set in a closed state; and at least two connection terminals coupled on either side of the fuse element and fixed onto the second portion, the first and second portions being implemented in such a way that they become separated from one another along an axis defined by the two connection terminals;

wherein the switching element comprises at least two connection studs connected respectively to the connection terminals of the protection device, and wherein the control means comprises movement means coupled to the switching element, the movement means allowing the switching element to be moved between an open position of the electrical circuit where the connection studs are decoupled from the electrical coupling terminals and a closed position of the electrical circuit where the connection studs are coupled to the electrical coupling terminals;

wherein the electrical contactor further comprises elastic contact means coupled to the movement means in such a way as to bring the switching element to the closed position of the electrical circuit, the elastic contact means comprising said elastic means of the protection device.

2. The device according to claim 1, wherein the elastic means are implemented in such a way as to allow the separation of the first portion and the second portion of the housing when the pressure in the housing is greater than a threshold.

3. The device according to claim 1, wherein the first portion and the second portion of the housing comprise a material with a non-carbonising surface on their inner surface.

4. The device according to claim 1, wherein the fuse element comprises at least one brazed joint implemented between the two connection terminals.

5. The electrical contactor according to claim 1, in which the contactor is a power contactor.

* * * * *